United States Patent [19]

Gaul

[11] 4,064,664

[45] Dec. 27, 1977

[54] CRYPT STRUCTURE

[76] Inventor: Michael F. Gaul, 2800 Lake Shore Drive, Chicago, Ill. 60657

[21] Appl. No.: 773,515

[22] Filed: Mar. 2, 1977

[51] Int. Cl.[2] ..... E04H 1/04

[52] U.S. Cl. ..... 52/136; 52/235; 52/385; 52/486

[58] Field of Search ..... 52/136, 137, 126, 124, 52/385, 391, 509, 487, 486, 125, 128, 134, 139, 235

[56] References Cited

U.S. PATENT DOCUMENTS

| | | | |
|---|---|---|---|
| 908,737 | 1/1909 | Broughton | 85/1 R |
| 1,898,026 | 2/1933 | Wilkins | 52/134 X |
| 2,853,870 | 9/1958 | Sinner et al. | 52/509 X |
| 2,860,504 | 11/1958 | Sinner et al. | 52/509 X |
| 2,912,714 | 11/1959 | Rich | 85/50 B |
| 3,006,443 | 10/1961 | Siler | 151/19 A |
| 3,319,983 | 5/1967 | Zibell | 52/487 X |
| 3,342,005 | 9/1967 | Rickards et al. | 52/509 X |
| 3,350,830 | 11/1967 | Smith, Jr. et al. | 52/509 |
| 3,831,895 | 8/1974 | Shubert | 52/486 X |
| 3,897,663 | 8/1975 | Gaul | 52/136 |

FOREIGN PATENT DOCUMENTS

| | | | |
|---|---|---|---|
| 2,364,224 | 11/1975 | Germany | 52/235 |
| 1,285,259 | 12/1968 | Germany | 85/1 R |
| 473,375 | 3/1929 | Germany | 85/9 R |
| 2,006,641 | 8/1971 | Germany | 52/235 |
| 61,837 | 5/1948 | Netherlands | 52/487 |

*Primary Examiner*—Leslie Braun

*Attorney, Agent, or Firm*—Hill, Gross, Simpson, Van Santen, Steadman, Chiara & Simpson

[57] ABSTRACT

In an above ground crypt structure, a crypt front or cover slab hanging or supporting arrangement allowing easy installation of the crypt covers and designed when used with a plurality of adjacently disposed crypt covers to allow the outer surfaces of the plurality of crypt covers to define a substantially planar surface.

7 Claims, 8 Drawing Figures

Fig. 1
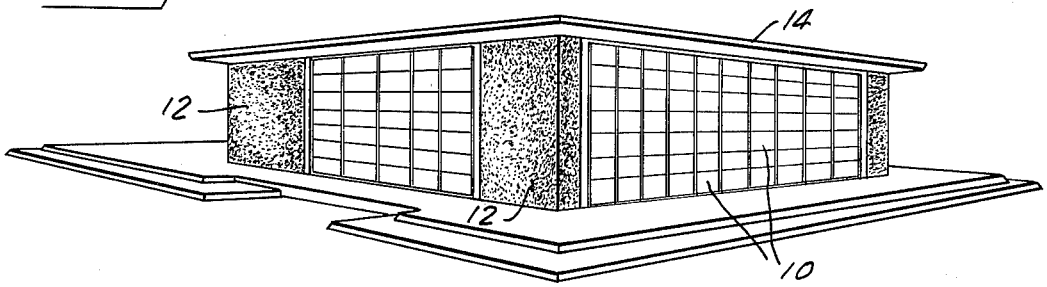
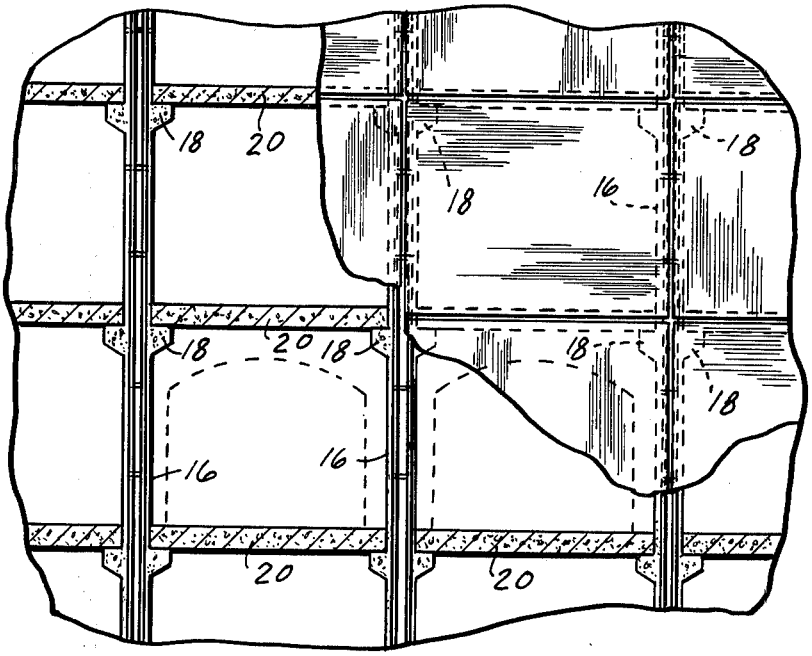
Fig. 2
Fig. 3
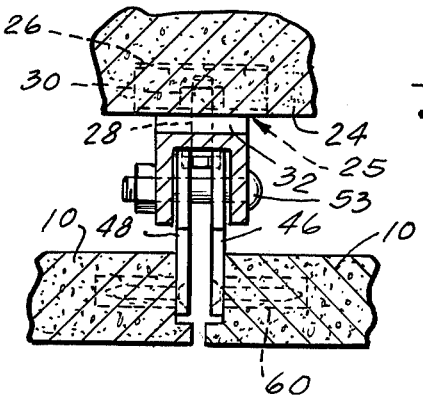
Fig. 8
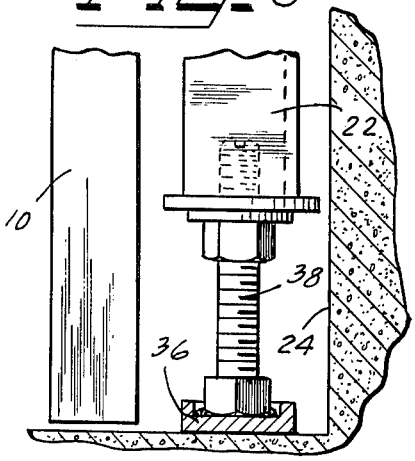

CRYPT STRUCTURE

This invention relates to an above ground crypt structure and more particularly to a crypt access means.

In my U.S. Pat. No. 3,897,663 entitled "CRYPT STRUCTURE" I disclose an improved crypt structure system including means for supporting crypt cover slabs which present an overall pleasing aesthetic appearance. The invention herein presents a further improved means for making, installing and supporting crypt cover slabs in a crypt system as described in the aforementioned U.S. Pat. No. 3,897,663. Because crypt cover slabs, typically of quarried stone, often turn out to be of somewhat different thicknesses and rectangular dimension when usual tolerances are observed, a solid front made up of a plurality of such cover slabs can turn out to present a front face in which not all of the crypt cover slab outer faces are in precise alignment. This may present something less than a completely aesthetically acceptable appearance. Accordingly, it becomes desirable to provide an improved and still less expensive means whereby crypt cover slabs varying slightly in dimension may be installed and supported in an array of covers in a crypt system to present a wall with an overall front face having a substantially aligned and planar configuration.

SUMMARY OF THE INVENTION

In accordance with the invention, vertical channels are positioned in substantially planar relationship and cover slabs are removably secured to their vertical edges to pairs of such channels. An elongated hanger is secured to the slab edge a fixed distance from the front surface thereof and is supported by an angled support in the channel coupled with a reference surface on the rear of the hanger to provide consistent planarity.

It is thus an object of the invention to provide means for supporting crypt cover slabs over the open ends of crypts, which slabs may be of slightly varying thicknesses, in such a manner that the outer faces of the slabs are maintained in substantial planar alignment.

A further object of this invention is to provide crypt hanger members of such a construction that they may be interchangeably mounted on opposite edges of a crypt slab thus eliminating the necessity of having right and left hand hanger members.

Other objects and advantages of the invention will become more apparent when considering the following description and accompanying drawings.

DESCRIPTION OF THE DRAWINGS

FIG. 1 is a perspective view of a crypt structure embodying the invention herein;

FIG. 2 is a side view in elevation and partially broken away of a portion of the crypt structure of FIG. 1;

FIG. 3 is a plan view in section of portions of two adjacent crypt cover slabs in an installed position;

FIG. 8 is a partial side elevational view of the base of channel structure, in place.

DESCRIPTION OF A PREFERRED EMBODIMENT

Figure 4:
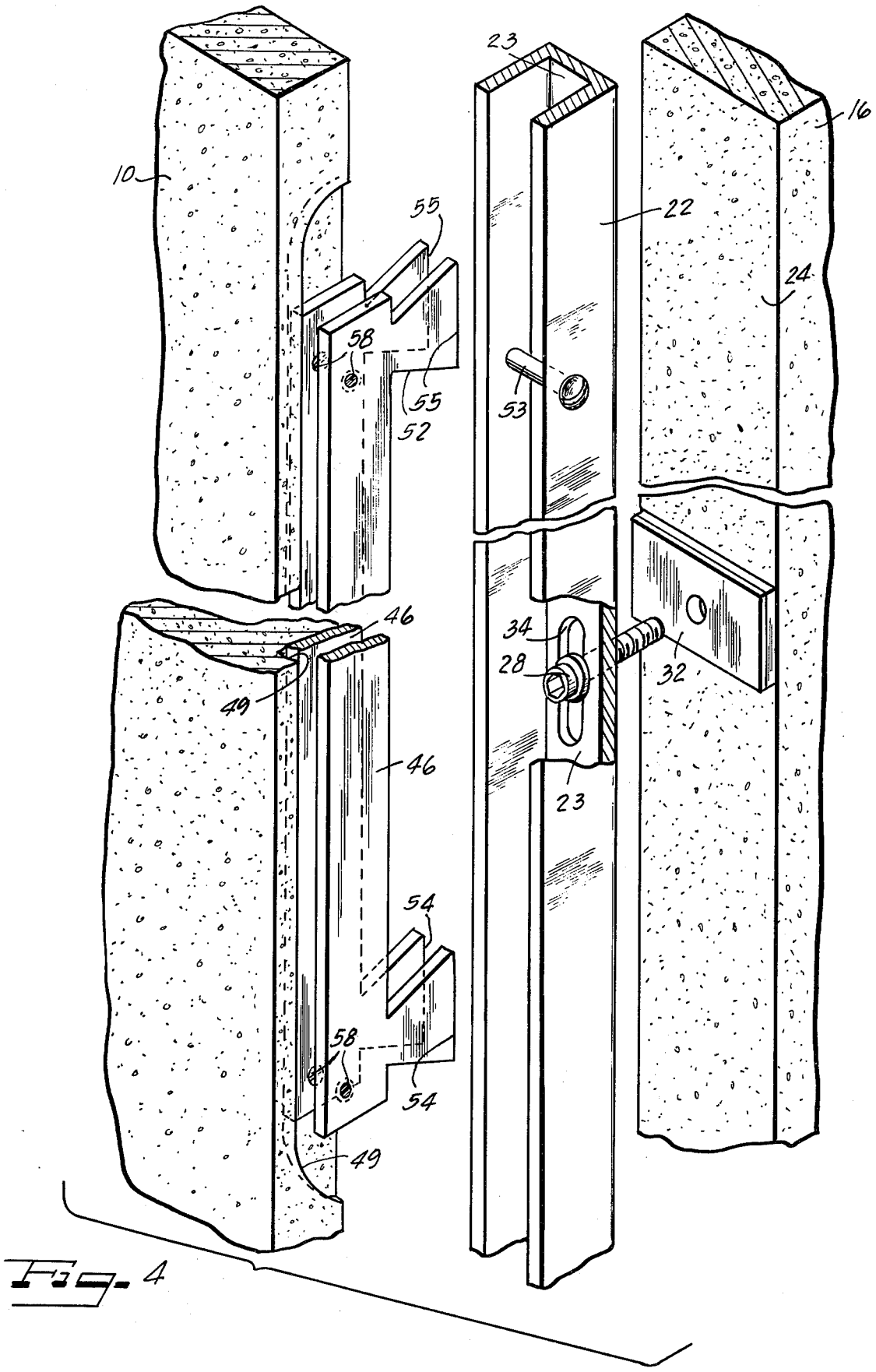
FIG. 4 is an isometric exploded view of an embodiment of my crypt cover slab and support system.

I refer now to the drawings wherein like reference characters in the several views designate similar parts.

As seen in FIG. 1, the crypt structure embodying the present invention comprises a building having a facade formed by crypt front or cover slabs of a rectangular configuration generally indicated at 10 framed by corner trim elements 12, all housed under a roof 14. The general overall structure of the building is similar to that disclosed in U.S. Pat. No. 3,897,663 entitled "CRYPT STRUCTURE". The slabs 10 usually are of a marble or granite construction. The crypt sidewalls 16 are designed as a standard wall unit. The sidewalls 16 may be provided at their lower ends with a rectangular base (not shown) which rest upon footings (not shown). The sidewalls 16 are provided with laterally projecting supports 18 which project to either side of the sidewalls for supporting crypt floor slabs 20.

A generally U-shaped metal channel member 22 is attached to each vertical weather-face 24 of the sidewalls 16 by a plurality of suitable nut and bolt arrangements, one of which is shown at 25. Each such arrangement may include a metal tube 26 embedded in the edge of sidewall 16 for receiving one end of a bolt 28 which is threaded to receive nut 30. The bolt 28 passes through an elongated vertically extending slot 34 in the channel member 22 thus permitting vertical adjustment of the position of the channel member 22. The lower end of the channel member 22 may be adjustably supported on the base slab for the walls 16 by a vertical elevator screw 38 threaded into the channel 22, or by shims beneath the channel. Variable shims 32 may be provided between the channels 22 and the walls 16 to assure exact planar positioning of the channels 22.

In the embodiment shown in FIG. 4, each cover slab is provided with a hanger 46 on each end edge thereof. As shown the hanger member 46 comprises an elongated member preferably of metal. The hanger 46 is provided with a sloped surface 52 which cooperates with a support 53 horizontally mounted in channel 22. The hanger has positioning edges 54, 55 that cooperate with the bottom surface 23 of channel 22.

The hanger member 46 is secured to the slab 10 preferably by means of screws 58 inserted through the member 46 and into conventional embedded fasteners 60. It is important that the screw receiving fasteners 60 be accurately positioned in the slab 10 with respect to the outer face 62 of the slab 10. The dimension $x$ between the screw 58 centerline and the face 62 must be maintained the same on all of the cover slabs in order to maintain excellent planar alignment of all the slabs 10 in an overall wall arrangement. Using this means to maintain the alignment of the cover slabs eliminates the problem of the variable thicknesses of the slabs that are used. Obviously the dimension $y$ from the screw hole centerline in the hanger member to the outer edge of the hanger member as well as the dimension $z$ may be accurately maintained in the manufacture of the hanger member. In the embodiment shown in FIGS. 5–7, the cuts 49 are easily made in a jig using a circular saw having its peripheral curvature that of the cut 49 as shown and moving the saw in the direction of arrow $w$ to within the same distance $v$ from surface 62 each time.

Figure 5:
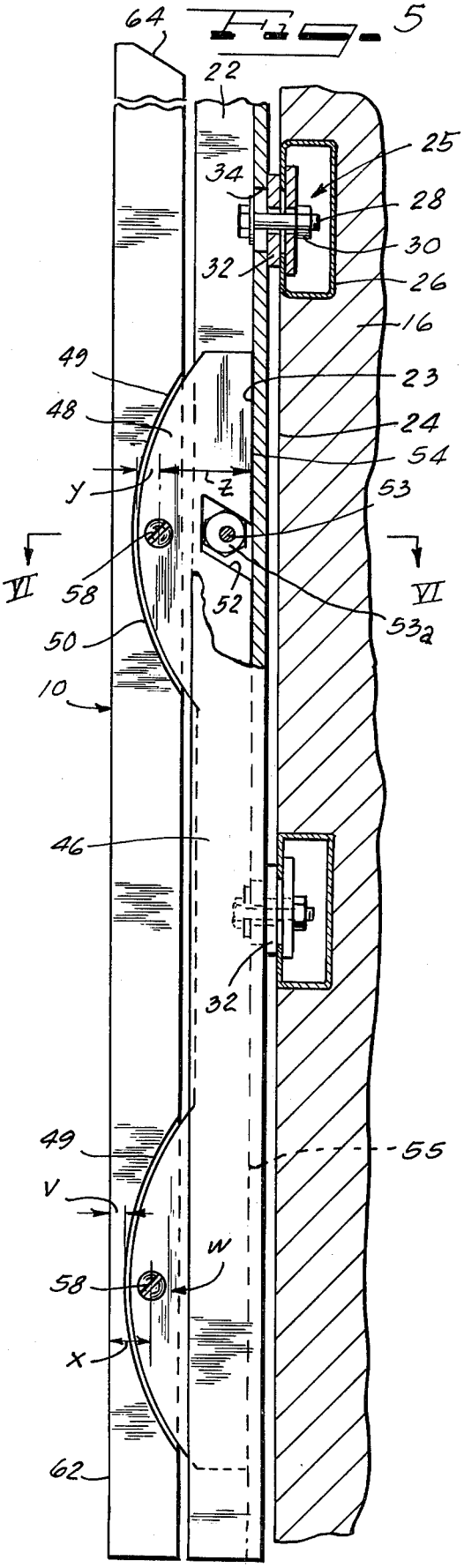
FIG. 5 is a side view in elevation of another embodiment showing portions of a crypt cover slab attached to a crypt.

With the hanger members 46 installed in the recessed ends of the slab it is readily apparent from FIGS. 4 and 5 that the slabs 10 are hung by sliding the slots 52 over the support 53, the reference surfaces 54 of the hanger coming to rest against the base or bottom portion 23 of the channel member 22. It will be observed that the upper edge of the slab 10 is cut away at 64 to eliminate a portion of the slab that would otherwise interfere with the installation into or removal of the slab from its supported position on the crypt walls.

Figure 6:
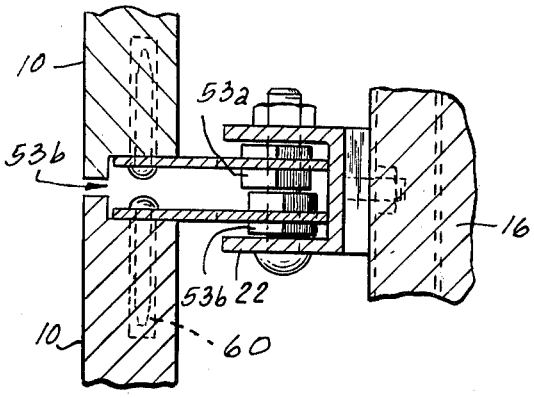
FIG. 6 is a plan view of the attachment support shown in FIG. 5.
Figure 7:
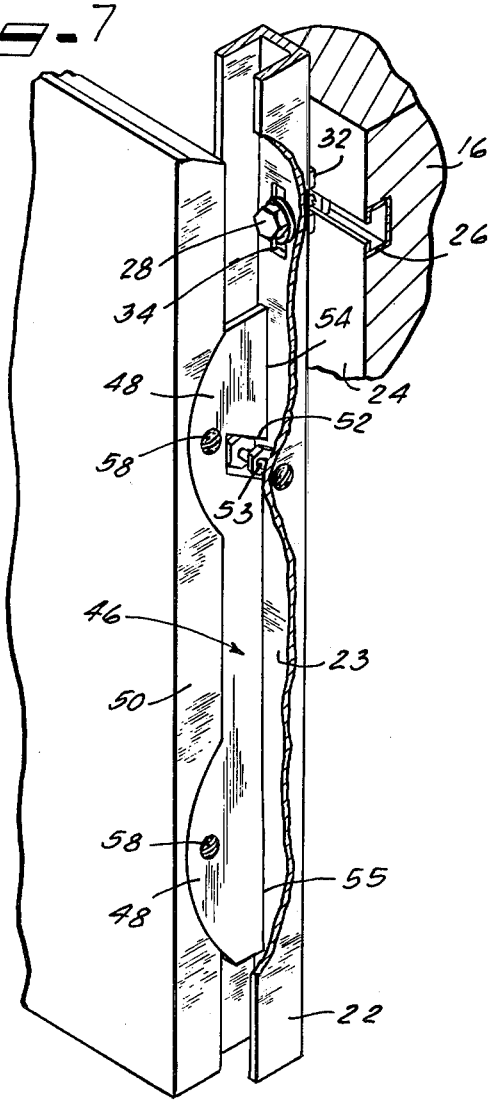
FIG. 7 is an isometric view of the structure shown in FIGS. 5 and 6.

While each hanger 46 is supported by only one support member 53, the slab is maintained in planar alignment by the fact that the hanger has spaced reference surfaces 54, 55 which are both accurately referenced to surface 62 of the slab 10. Slight vertical adjustment of the slab 10 may be made after installation by rotating the hexagonally headed eccentric 53*a* via a flat, thin, open-end wrench inserted into the space 53*b* between slabs, as shown in FIG. 6 and rotating member 53*a*. In practice, a suitable member 53*a* comprises a hexagonal member one-half inch between flats with the smooth hole for member 53 bored off-center 1/16 inch, providing a vertical adjustment range of about ⅛ inch, if needed. The flat surface in contact with surface 52 keeps the member 53*a* in adjusted position. The hangers on both sides of the slab are identical, so that only a single form of hanger member is required.

It will be apparent that I have advantageously provided simple and reliable means for supporting a plurality of crypt cover slabs in precise alignment thereby effecting a pleasing aesthetic appearance. While preferred embodiments of the invention have been disclosed, it will be appreciated that these have been shown by way of example only, and the invention is not to be limited thereto as other variations will be apparent to those skilled in the art and the invention is to be given its fullest possible interpretation within the terms of the following claims.

I claim as my invention:

1. In a connecting system in a crypt building structure for retaining a plurality of substantially similar slab elements in position on a generally upright grid composed of a plurality of spaced walls, the combination comprising: vertical channel members vertically and forwardly adjustably connected to the edges of the spaced walls; support means attached to adjacent ones of said channel members for supporting each slab element; at least one crypt cover slab; hanger members attached to opposing vertical side walls of said cover slab at the same reference distance from the front surface of the slab; extending rearwardly of the slab to which the hanger member is attached, vertically spaced protruding reference surfaces on said hanger members cooperating with a vertically extending alignment surface of said channel member to thereby reference said front surface of the slab to the channel member, said support means and hanger member providing a pin and sloping ledge surface connection.

2. The combination of claim 1 wherein the hanger members each comprise an elongated member providing said vertically spaced reference surfaces; and the opposing vertical side walls of said cover slab have recesses to accommodate each hanger member.

3. The combination of claim 2 wherein each hanger includes a ledge surface thereon slanting upwardly toward the front of the slab for cooperation with a horizontal pin on said channel member.

4. The combination of claim 1 wherein eccentric adjustments are mounted on said pin to provide adjustment between said pin and ledge.

5. The combination of claim 3 wherein eccentric adjustments are mounted on said pin to provide adjustment between said pin and ledge.

6. The structure of claim 4 wherein said eccentric comprises a faceted periphery providing a plurality of flat surfaces for adjustable cooperation with said ledge.

7. The structure of claim 1 wherein the hanger members on opposite side walls of each slab are identical to each other.

* * * * *